US007356291B2

(12) United States Patent
Izumi et al.

(10) Patent No.: US 7,356,291 B2
(45) Date of Patent: Apr. 8, 2008

(54) DEVELOPING UNIT, IMAGE FORMING APPARATUS METHOD THAT SUPPLIES INVERSE TRANSFER PREVENTING AGENT WITH INVERSE POLARITY

(75) Inventors: Takao Izumi, Yokohama (JP); Haruhiko Ishida, Tokyo (JP); Masashi Takahashi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 179 days.

(21) Appl. No.: 11/242,043

(22) Filed: Oct. 4, 2005

(65) Prior Publication Data

US 2007/0077102 A1 Apr. 5, 2007

(51) Int. Cl.
*G03G 15/09* (2006.01)
*G03G 15/095* (2006.01)

(52) U.S. Cl. ..... 399/267; 399/264

(58) Field of Classification Search ..... 399/149, 399/150, 120, 175, 262, 264, 267, 313, 314
See application file for complete search history.

(56) References Cited

U.S. PATENT DOCUMENTS 6,647,229 B2 * 11/2003 Haraguchi et al. ..... 399/149
2001/0016130 A1 * 8/2001 Bessho et al. ..... 399/252

FOREIGN PATENT DOCUMENTS

JP 6-110343 A 4/1994
JP 2002-62724 A 2/2002
JP 2002-357939 A 12/2002

* cited by examiner

*Primary Examiner*—Hoang Ngo
(74) *Attorney, Agent, or Firm*—Foley & Lardner LLP

(57) ABSTRACT

An image forming apparatus of the invention holds a first developing agent of a first color and inverse transfer preventing agent, supplies the first developing agent with predetermined potential, supplies the first developing agent to an image portion of an image carrier, supplies the inverse transfer preventing agent with the first developing agent and electric charge of an inverse polarity, supplies the inverse transfer preventing agent to a non-image portion having a predetermined potential difference relative to an image portion, brings the image carrier into contact with a transfer object medium to which a second developing agent of a second color different from the first color is already transferred and transfers the first developing agent to the transfer object medium.

22 Claims, 3 Drawing Sheets

DEVELOPING UNIT, IMAGE FORMING APPARATUS METHOD THAT SUPPLIES INVERSE TRANSFER PREVENTING AGENT WITH INVERSE POLARITY

BACKGROUND OF THE INVENTION

1. Field of the Invention

The present invention relates to an image forming apparatus for forming an image using a developing agent and more particularly to a color image forming apparatus for forming an image with developing agents of plural colors.

2. Description of the Related Art

In recent years, a variety of color image forming apparatuses capable of outputting color images, such as color copiers and color printers have been provided following demands the market.

For example, an image forming apparatus which transfers an image by using a semiconductive transfer belt and a transfer roller provided on the rear face of the transfer belt has been well known as disclosed in Jpn. Pat. Appln. KOKAI Publicaiton No. 6-110343. This publication has disclosed that an image is transferred by applying a transfer bias to the transfer roller.

In the color image forming apparatus which forms an image with plural toners, namely, yellow (Y), magenta (M), cyan (C) and black (Bk), as disclosed in the above publication, the following methods have been well known;

(1) A method of forming toner images of four colors on a photoconductor one over another and transferring an image composed of these plural toner images to a transfer object medium at once.

(2) A transfer drum method of forming images of four colors on a transfer object medium held on a transfer drum with four rotations of the drum, such that the toner images from the transfer drum rotating a single turn for each color are placed into layers.

(3) An intermediate transfer body method of forming a color image by placing toner images of four colors one over another on an intermediate transfer body and transferring that image to a transfer object medium at once.

(4) A consecutive four-drum method in which with four photoconductors disposed in parallel, images of four colors are formed to a transfer object medium moving in an opposing condition, corresponding to a rotation direction of each of four photoconductors rotating in the same direction, during each passing of the transfer object medium.

Because the color image forming apparatus which adopts the consecutive four-drum method can form a color image, which is transferred in multi-layers onto a transfer object medium while the transfer object medium passes a side opposing the four photoconductors, an image can be formed approximately in a quarter of time taken for the other methods 1 to 3 to proceed the four-color image forming process and thus, this method is suitable for an image forming apparatus for high-speed color image printing.

However, such a color image forming apparatus adopting the consecutive four-drum method carries a risk that part of a previously transferred toner image may be inversely transferred to a photoconductor in a process in which toner images of respective colors formed on the photoconductors are transferred to a transfer object medium or a transfer belt successively. That is, when a color image is formed, a toner adhering to the transfer object body or the transfer belt can be inversely transferred to a photoconductor of a different color when the toner image of a next color is formed. If this inverse transfer occurs, a developing agent transferred inversely invades into a photoconductor or a developing unit of a next color unless a photoconductor cleaner is provided, so that mixing of colors occurs. Due to this mixing of colors, the hue of a formed image changes thereby making it impossible to reproduce a color stably.

On the other hand, even an image forming apparatus equipped with the cleaner has such a problem that the quantity of adhering toner of each color toner image transferred onto the transfer object medium or the transfer belt is decreased by the inverse transfer. Because a transferred toner image of a first color passes three photoconductors until a toner image of a fourth color is transferred, reduction of the quantity of the adhering toner is more remarkable than other transferred toner images. Thus, this kind of color image forming apparatus has another problem that a difference in density occurs between toner images of respective colors, thereby lowering picture quality.

BRIEF SUMMARY OF THE INVENTION

According to an aspect of the present invention, there is provided a developing unit including: a developing section including a first accommodating section which accommodates a developing agent, and a developing agent supply mechanism which supplies the developing agent to an image carrier with a predetermined potential difference formed relative to the image carrier; and an inverse transfer preventing section including a second accommodating section which accommodates an inverse transfer preventing agent, and a mechanism to supply inverse transfer preventing agent which supplies the inverse transfer preventing agent supplied with inverse polarity of the developing agent to the image carrier with a predetermined potential difference formed relative to the image carrier.

According to another aspect of the present invention, there is provided an image forming apparatus including: a first image carrier on which an electrostatic latent image constituted of an image portion having a predetermined potential and a non-image portion having a different potential from the potential of the image portion is formed; a first developing agent supply mechanism which supplies the developing agent of a first color to the image portion by supplying electric charge of polarity corresponding to the image portion to the developing agent of the first color; and an inverse transfer preventing section which supplies the inverse transfer preventing agent to the non-image portion by supplying the inverse transfer preventing agent with electric charge having an inverse polarity to the developing agent of the first color.

According to further aspect of the present invention, there is provided an image forming method including: charging a surface of an image carrier with a first potential; forming an image portion having a second potential different from the potential of the first potential on the surface by irradiating light corresponding to predetermined image information; applying developing agent of the first color charged with a predetermined polarity on the image portion; applying the inverse transfer preventing agent charged with an inverse polarity to the developing agent on a non-image portion having the first potential; and transferring an image of a developing agent of the first color to a transfer object medium to which an image of a second developing agent different from the first color is already transferred.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an example of an image forming apparatus to which an embodiment of the present invention is applied will be described with reference to the accompanying drawings.

Figure 1:
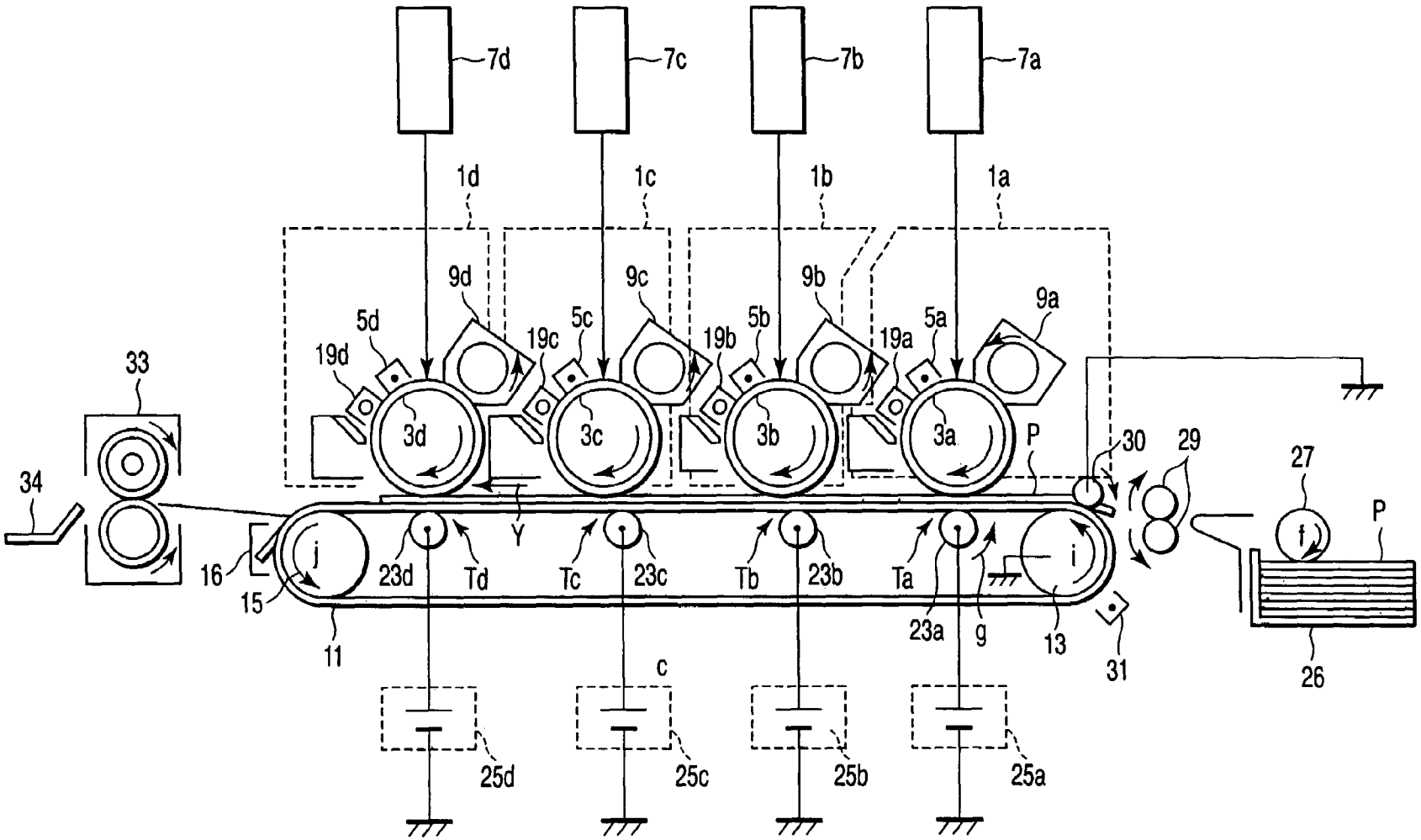
FIG. 1 is a schematic view for explaining an image forming apparatus to which an embodiment of the present invention can be applied.

FIG. 1 is a sectional view showing a four-drum tandem type color image forming apparatus applicable to the image forming apparatus of the present embodiment.

As shown in FIG. 1, the 4-drum tandem type color image forming apparatus includes process units 1*a*, 1*b*, 1*c* and 1*d* as image forming means. The process units 1*a* to 1*d* are image forming means to which yellow (Y), magenta (M), cyan (C) and black (Bk) developing agents are applied and which is detachable to the image forming apparatus main body. The respective process units 1*a* to 1*d* have photoconductor drums 3*a*, 3*b*, 3*c* and 3*d* as an image carrier (image carrying means) and developing agent image is formed in a photosensitive area formed on an external peripheral face of each of these photoconductor drums 3*a* to 3*d*. That is, the photoconductor drums 3*a* to 3*d* have a photosensitive area whose electrical potential changes if light is irradiated on their external peripheral face and then, an image area and a non-image area, each having a different potential, are formed in this photosensitive area. As an image carrier, it is possible to use a photoconductor belt instead of a photoconductor drum.

Lithography units 7*a*, 7*b*, 7*c* and 7*d* which irradiate each of the photoconductor drums 3*a* to 3*d* with a laser beam whose intensity is changed corresponding to an image signal supplied form an image formation processing control unit or the like (not shown) are disposed in the vicinity of the respective process units 1*a* to 1*d*. Laser beam output from the lithography units 7*a* to 7*d* can have a predetermined light intensity corresponding to the density of an image or the like. Further, as the lithography units 7*a* to 7*d*, an LED may be used instead of a laser.

A carrying belt (carrying unit) 11 is provided as carrying means for carrying a paper (transfer object medium) P as an image forming object medium on a side opposing the photoconductor drums 3*a* to 3*d* of the respective process units 1*a* to 1*d*. This carrying belt 11 carries the paper P in a direction of an arrow Y and the paper P makes contact with a developing agent image formed on each of the photoconductor drums 3*a* to 3*d*.

The carrying belt 11 has a width almost equal to the length of the photoconductor drum 3*a* in a direction perpendicular to the carrying direction Y of the paper P (depth direction of the figure or length direction of the photoconductor drum). This carrying belt 11 is a seamless belt, supported by a drive roller 15 which rotates the carrying belt 11 at a predetermined speed and a driven roller 13. The distance from the drive roller 15 to the driven roller 13 is approximately 300 mm. The drive roller 15 and the driven roller 13 are provided to be rotatable in directions indicated with an arrow j and an arrow i respectively. With a rotation of the drive roller 15, the carrying belt 11 rotates and the driven roller 13 is rotated. The carrying belt 11 is supplied with sufficient tension so that it does not slip outward of the driven roller 13 due to a summation.

Next, the process unit 1*a* will be described.

The process unit 1*a* includes a photoconductor drum (second image carrier, second image carrying means) 3*a*, an electrostatic charger 5*a*, a developing unit 9*a* and a destaticizing lamp 19*a*.

The photoconductor drum 3*a* has a photoconductor (photosensitive area) on its external peripheral face, capable of holding a change in electrical potential as an electrostatic image for a predetermined time interval, the electrical potential of an area irradiated with light being changed when the photoconductor drum is irradiated with light with a predetermined potential applied. The photoconductor drum 3*a* is a cylinder having a diameter of 30 mm for example, which is provided rotatably in a direction of the illustrated arrow (clockwise direction). The destaticizing lamp 19*a*, the electrostatic charger 5*a* and the developing unit 9*a* are disposed along the rotation direction around the photoconductor drum 3*a*.

The electrostatic charger 5*a* is provided on the surface of the photoconductor drum 3*a* so as to charge the photoconductor drum 3*a* negatively (−) uniformly. According to the present embodiment, the surface of the photoconductor drum 3*a* is charged uniformly −600 V. The electrostatic charger 5*a* may be a corona wire, a contact roller or a contact blade. Laser from the lithography unit 7*a* is projected to the upstream of the developing unit 9*a* in the downstream of the photoconductor drum 3*a*. An electrostatic latent image is formed on the surface of the photoconductor drum 3*a* charged by the electrostatic charger 5*a*. That is, of the surface of the photoconductor drum 3*a* negatively charged uniformly, the surface potential of an area irradiated with laser from the lithography unit 7*a* approaches zero (0) V. In other words, the image area irradiated by the lithography unit 7*a* has a voltage of approximately zero while the non-image area not irradiated by the lithography unit 7*a* has a voltage of approximately −600 V.

The developing unit 9*a* accommodates a yellow developing agent and is disposed in the downstream of the photoconductor drum 3*a* with respect to an irradiation position by the lithography unit 7*a* and supplies the yellow developing agent to an image portion of an electrostatic latent image on the photoconductor drum 3*a* formed by the lithography unit 7*a* so as to form a developing agent image. If speaking in detail, the yellow developing agent is two-component developing agent containing yellow (Y) toner and ferrite carrier. In this yellow developing agent, the yellow toner is charged negatively (−) and the ferrite carrier is charged positively (+). Thus, the yellow toner charged negatively supplied to the photoconductor drum 3*a* is attracted to an image area (surface potential≈0 V) irradiated with laser of the photoconductor drum 3*a* and adheres thereto. That is, the developing unit 9*a* develops an electrostatic latent image on the photoconductor drum 3*a* inversely, so that the electrostatic latent image on the photoconductor drum 3*a* is visualized. In the meantime, toner charged negatively is called negatively chargeable toner.

The destaticizing lamp 19*a* is disposed downstream with respect to a contact position between the photoconductor drum 3*a* and paper P and destaticizes surface charge on the photoconductor drum 3*a* by irradiating with light uniformly after the developing agent image on the photoconductor drum 3*a* is transferred to the paper P carried by the carrying belt 11.

As a consequence, a cycle of image formation is completed and in a next image forming process, the electrostatic charger 5*a* charges a non-charged photoconductor drum 3*a* uniformly again.

In addition to the process unit 1*a*, process units 1*b*, 1*c* and 1*d* are disposed on the carrying belt 11 along the conveying direction of the paper P between the drive roller 15 and the driven roller 13.

The process units 1*b* to 1*d* have the same structure as the process unit 1*a*. That is, the photoconductor drums 3*b*, 3*c* and 3*d* are provided in the substantial center of each process unit. Electrostatic chargers 5*b*, 5*c* and 5*d* are provided around each photoconductor drum. Developing units 9*b*, 9*c* and 9*d* and destaticizing lamps 19*b*, 19*c* and 19*d* are provided in the downstream of irradiated positions by the lithography units 7*b*, 7*c* and 7*d* located in the downstream of the respective electrostatic chargers 5*b* to 5*d*. In these process units 1*b* to 1*d*, the colors of developing agents stored in the developing units 9*b* to 9*d* are different. The developing unit 9*b* contains a magenta developing agent, the developing unit 9*c* contains a cyan developing agent and the developing unit 9*d* contains a black developing agent.

The paper P carried by the carrying belt 11 makes contact with the photoconductor drums 3*a* to 3*d* successively. Transfer units 23*a*, 23*b*, 23*c* and 23*d* are provided as transfer means in the vicinity of the contact positions between the paper P and the respective photoconductor drums 3*a* to 3*d* corresponding to each of the photoconductor drums 3*a* to 3*d*. The transfer units 23*a* to 23*d* are provided such that they are in contact with the rear face of the carrying belt 11 below the corresponding photoconductor drums 3*a* to 3*d* and face the process units 1*a* to 1*d* across the carrying belt 11. Transfer areas Ta, Tb, Tc and Td, in which toner image is transferred to the paper P from each of the photoconductor drums 3*a* to 3*d*, are defined at positions which the process units 1*a* to 1*d* and the photoconductor drums 3*a* to 3*d* face across this carrying belt.

The transfer unit 23*a* is connected to the positive side (+) of a DC power supply 25*a* which is voltage applying means. Likewise, the transfer units 23*b*, 23*c* and 23*d* are connected to the positive sides of the DC power supplies 25*b*, 25*c* and 25*d* respectively. When the paper P reaches a transfer area Ta, the transfer unit 23*a* is applied with approximately +1000 V transfer bias voltage from the DC power supply 25*a*. As a consequence, transfer electric field is formed between the transfer unit 23*a* and the photoconductor drum 3*a*, so that yellow toner image on the photoconductor drum 3*a* is transferred to the paper P following the transfer electric field.

When the paper P reaches the transfer area Tb, the transfer unit 23*b* is applied with approximately 1200 V transfer bias voltage from the DC power supply 25*b*. As a result, magenta toner image can be transferred onto the yellow toner image. When the paper P reaches the transfer area Tc, the transfer unit 23*c* is applied with approximately +1400 V bias voltage from the DC power supply 25*c*. As a result, cyan toner image can be transferred onto the magenta toner image. When the paper P reaches the transfer area Td, the transfer unit 23*d* is applied with approximately +1600 V bias voltage from the DC power supply 25*d*. Consequently, black toner image can be transferred onto the cyan toner image. In this way, by applying a voltage higher than the transfer bias used for transferring of the developing agent already transferred to the transfer unit, a next toner image can be transferred to that toner image such that the next toner image is overlaid on the former one.

Referring to FIG. 1, a paper feeding cassette 26 for accommodating the papers P is provided on the right with respect to the front side of the carrying belt 11. The image forming apparatus main body is provided with a pickup roller 27 for picking up the papers P one by one from the paper feeding cassette 26 such that it is capable of rotating in the direction of an arrow f. A pair of resist rollers 29 are provided rotatably between the pickup roller 27 and the carrying belt 11. The pair of the resist rollers 29 supply the paper P onto the carrying belt 11 at a predetermined timing.

A metallic roller 30 for attracting the paper P to the surface of the carrying belt 11 electrostatically is disposed on the carrying belt 11. The metallic roller 30 is grounded (earthed).

A corona charger 31 is provided via the carrying belt 11 below the driven roller 13 with the driven roller 13 of the carrying belt 11 as an opposing electrode in order to charge the belt for attracting the paper.

On the other hand, in FIG. 1, a fixing device 33 for fixing the developing agent transferred by each process unit 1*a* to 1*d* onto the paper P and a discharged paper tray 34 to which the paper P fixed by the fixing device 33 is discharged are provided on the left with respect to the front side of the carrying belt 11. The fixing device 33 is constructed to provide predetermined heat and pressure to the paper P holding the toner image and fix melted toner image to the paper P.

According to the present embodiment, the carrying belt 11 is formed of polyimide of 100 μm thickness in which carbons are dispersed uniformly. This carrying belt 11 has an electric resistance of $10^{10}$ Ωcm, indicating semiconductivity. The material of the carrying belt 11 may be of any material as long as it indicates semiconductivity whose volume resistance is $10^{8}$-$10^{13}$ Ωcm. For example, in addition to polyimide in which carbons are dispersed, it is possible to use polyethylene terephthalate, polycarbonate, polytetrafluorethylene, polyvinylidene fluoride or the like, in which conductive particles such as carbons are dispersed. It is possible to use a polymer film whose electric resistance is adjusted by adjustment of composition instead of any conductive particles. Alternatively, it is possible to use a polymer film mixed with ion conductive substance or to use silicone rubber, urethane rubber or other rubber whose electric resistance is relatively low.

Next, by referring to FIG. 2, the developing unit 9*b* disposed in the downstream of the developing unit 9*a* which stores the yellow developing agent in the advancing direction of the paper P will be described.

Figure 2:
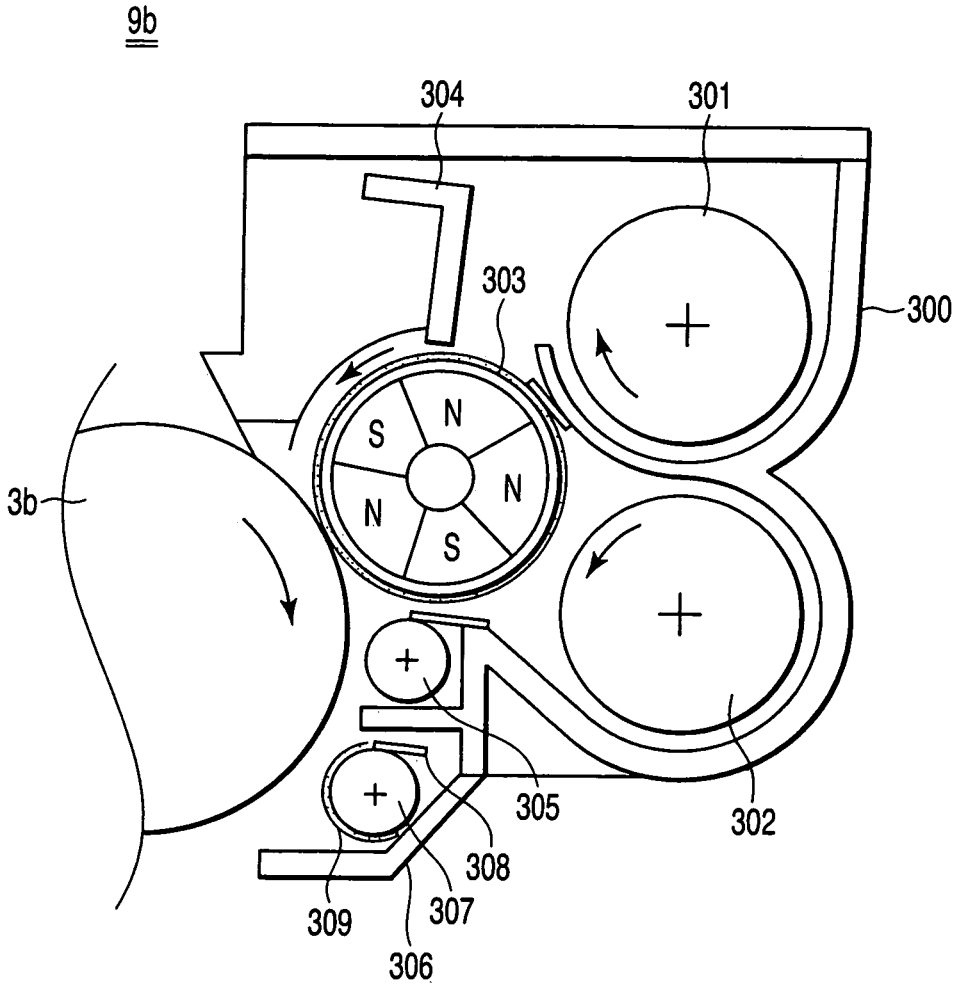
FIG. 2 is a schematic sectional view for explaining a developing unit loaded on the image forming apparatus shown in FIG. 1.

As shown in FIG. 2, the developing unit 9*b* includes a developing unit casing (first accommodating section) 300 which accommodates a two-component developing agent (hereinafter referred to as magenta developing agent) including magenta toner (M toner) and ferrite carrier, and includes a first mixer 301 and a second mixer 302 (charging mechanism), which agitate the magenta developing agent accommodated in the developing unit casing 300 so as to supply the magenta developing agent with a predetermined potential by frictional electrification. The first mixer 301 and second mixer 301 are rotated around a rotation axis extending substantially parallel to the photoconductor drum 3*b*.

The developing unit 9*b* further includes a developing sleeve 303, a doctor blade 304, a collection roller (collecting member, collecting means) 305, and an inverse transfer preventing section 306. A structure which includes this developing unit casing (first accommodating section, first accommodating means) 300, first mixer 301 and a second mixer (charging mechanism, charging means), the developing sleeve (developing member, developing means) 303, the doctor blade 304, the collection roller 305 and the like and which is for supplying the magenta developing agent to the photoconductor drum 3*b* is called developing agent supply mechanism (first developing supply mechanism, developing agent supplying means).

The developing sleeve 303 is a sleeve containing plural magnets having different polarities and rotates in an opposite direction to the photoconductor drum 103, holding the developing agent received form the first mixer 301 and the second mixer 302, namely, the magenta toner and carrier. A bias power supply (not shown) is connected to the developing sleeve 303, which is applied with predetermined developing bias. According to the present embodiment, the developing bias of the developing unit 9*b* is approximately −380 V like the developing unit 9*a*. Thus, positively charged carrier is held by the developing sleeve 303 and negatively charged magenta toner is held by the developing sleeve 303 with the carrier interposed therebetween.

The doctor blade 304 is provided in the downstream in the rotation direction of the developing sleeve 303 with respect to a developing agent supply point from the first mixer 301 so as to control the quantity of the developing agent held at the surface of the developing sleeve 303.

Thus, magenta toner held by the developing sleeve 303 adjacent to the photoconductor drum 3*b* adheres to an image portion of electrostatic latent image on the photoconductor drum 3*b* based on a electrical potential relationship with the photoconductor drum 3*b*. That is, the magenta toner negatively charged is attracted because of a difference in potential to a high potential image area (surface potential≈0 V) in an electrostatic latent image formed on the photoconductor drum 3*b* and adheres to the image area of the photoconductor drum 3*b*.

As a consequence, the electrostatic latent image formed on the photoconductor drum 3*b* is converted to a magenta toner image. In the meantime, the present invention is not limited to this example, and as the developing sleeve 303, it is possible to use a magnet roller having a plurality of polarities.

The collection roller 305 is disposed in the downstream of the developing sleeve 303 in the rotation direction of the photoconductor drum 3*b* so as to collect scattered toner generated in developing process, in which the developing sleeve 303 provides the surface of the photoconductor drum 3*b* with toner.

The inverse transfer preventing section (inverse transfer preventing means) 306 is disposed in the downstream of the collection roller 305 in the rotation direction of the photoconductor drum 3*b*, is equipped with a sleeve 307 and a blade 308 which function as a mechanism to supply inverse transfer preventing agent (means to supply inverse transfer preventing agent), and has a structure (second accommodating section, second accommodating means) for holding the inverse transfer preventing agent 309. The inverse transfer preventing agent is a particle constituted of resin at least having light transmittance and according to the present embodiment, polyester base optically transparent resin particle having a charging amount of 20 micro coulomb/g and average diameter of 10 μm. Further, this optically transparent resin particle 309 is a positively chargeable optically transparent resin particle having a characteristic of being easily charged positively (+) and its detail will be described later.

The sleeve (inverse transfer preventing agent carrier) 307 is supported rotatably to the photoconductor drum 3*b* with a predetermined gap formed therebetween. According to the present embodiment, the gap between the sleeve 307 and the photoconductor drum 3*b* is approximately 100 μm. The sleeve 307 has a shaft portion and an external peripheral face constituted of conductive aluminum, stainless or the like, and DC bias power supply and AC bias power supply (voltage applying mechanism) are connected to the shaft portion. This DC bias power supply and AC bias power supply apply bias voltage by overlaying AC voltage on DC voltage if development is instructed. As a consequence, the sleeve 307 forms a predetermined potential difference relative to the photoconductor drum 3*b*. According to the present embodiment, bias voltage applied by the DC bias power supply and the AC bias power supply is approximately 380 V like the development bias of the developing unit 9*b* while AC voltage Vpp is 1400 V with the frequency of 1800 Hz.

The blade 308 is, for example, a polyurethane blade containing polyurethane resin and provided such that it is capable of making contact with the sleeve 307. The blade 308 charges the surface of the sleeve 307 by friction of the rotating sleeve 307. The sleeve 307 charged by friction electrostatically holds positively charged optically transparent resin particle 309, so that thin film of the optically transparent resin particle 309 is formed on the surface of the sleeve 307.

As a result, the optically transparent resin particles 309 fly to the photoconductor drum 3*b* due to the potential difference formed between the photoconductor drum 3*b* and the sleeve 307. That is, the positively charged optically transparent resin particles 309 are attracted by the potential difference relative to a non-image area of the photoconductor drum (surface potential≈−600 V) and adheres to the non-image area. In the meantime, it becomes easy for the optically transparent resin on the sleeve 308 to fly to the photoconductor drum by applying the bias voltage produced by overlaying the AC voltage on the DC voltage on the sleeve 307.

In the meantime, it is possible to use a rotatable brush roller instead of the sleeve 307.

The developing units 9*c* and 9*d* have the same structure as the developing unit 9*c*. The developing unit 9*c* includes the developing unit casing 300 accommodating the two-component developing agent (hereinafter referred to as cyan developing agent) containing cyan toner (C toner) and ferrite carrier, the developing sleeve 303, the doctor blade 304, the collection roller 305 and the inverse transfer preventing section 306. The developing unit 9*d* includes the developing unit casing 300 accommodating the two-component developing agent (hereinafter referred to as black developing agent) containing black toner (Bk toner) and ferrite carrier, the developing sleeve 303, the doctor blade 304, the collection roller 305 and the inverse transfer preventing section 306.

That is, the developing units 9*b* to 9*d*, which transfer multiple layers by overlaying a color toner to the paper P on which another toner has been already transferred, has the inverse transfer preventing section 306 and are constructed such that after the optically transparent resin particles 309 are adhered to the non-image area of each of the photoconductor drums 3*b* to 3*d* (first image carrier, first image carrying means), they are transferred onto the paper P.

On the other hand, the developing unit 9*a* is different from the developing units 9*b* to 9*d* in that it has no inverse transfer preventing section while the other structure is the same. That is, the developing unit 9*a* includes the developing unit casing 300 accommodating the yellow developing agent, the developing sleeve 303, the doctor blade 304 and the collection roller 305.

Next, the transfer units 23*a* to 23*d* will be described by taking the transfer unit 23*a* as an example, with reference to FIG. 3.

Figure 3:
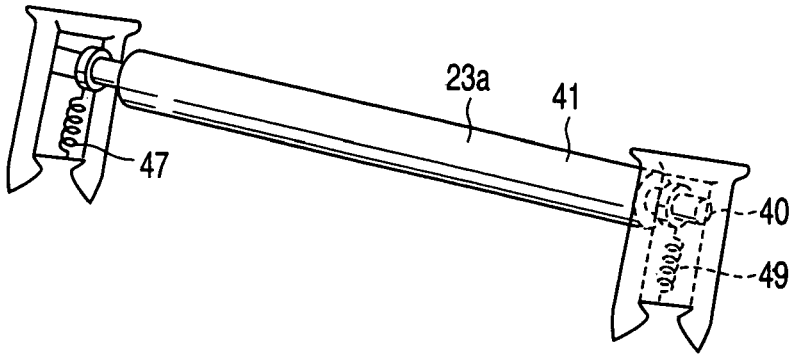
FIG. 3 is a perspective view of a transfer unit loaded on the image forming apparatus shown in FIG. 1.
Figure 4:
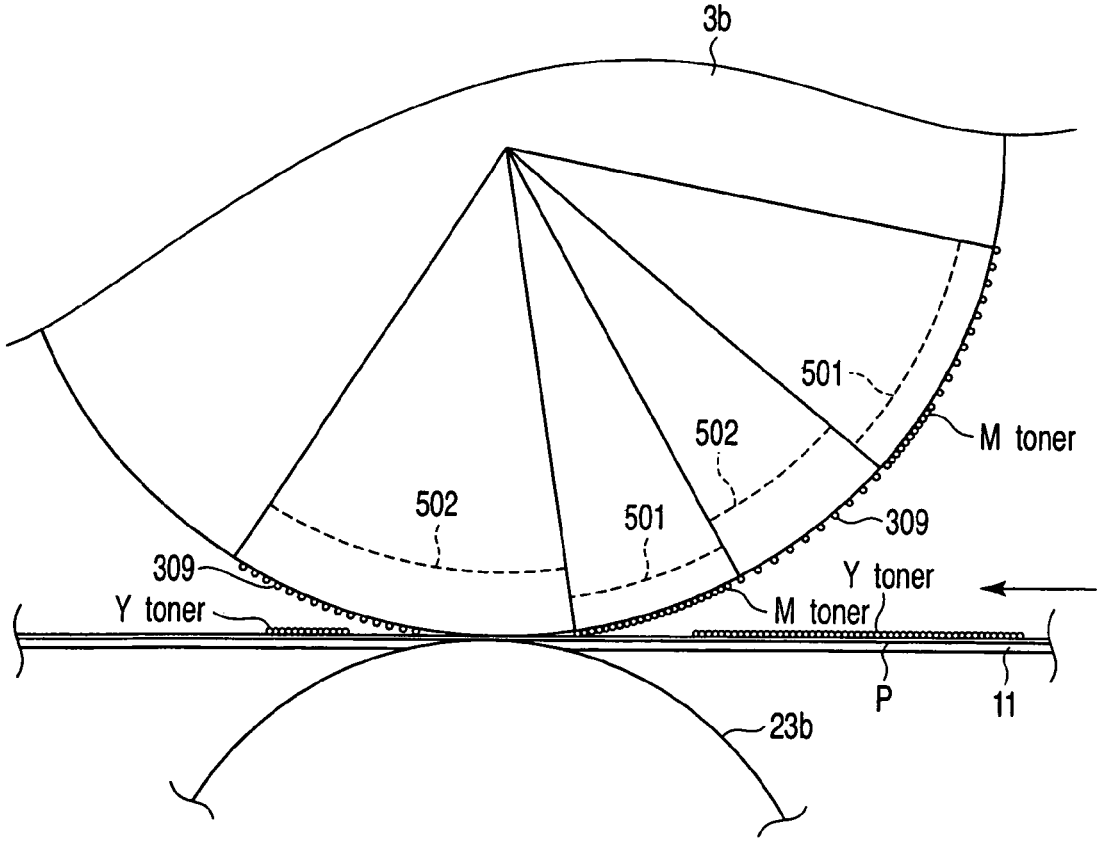
FIG. 4 is a schematic sectional view for explaining a transfer of a developing agent image developed by the developing unit shown in FIG. 2.

As shown in FIG. 3, the transfer unit 23*a* is constituted of a core metal 40 and a conductive foamed urethane roller 41 disposed outside this core metal 40. The core metal 40 is formed in a diameter (ϕ) of 10 mm and the conductive foamed urethane roller 41 is formed in an outside diameter (ϕ) of 18 mm. Electric resistance between the core metal 40 and the surface of the conductive foamed urethane roller 41 is approximately $10^6\Omega$. The constant voltage DC power supply 25*a* (see FIG. 1) is connected to the core metal 40. The conductive foamed urethane roller 41 is formed as conductive by dispersing carbons outside the core metal 40.

For example, a spring 47 and a spring 49 are provided as biasing means on both ends of the core metal 40 and the transfer roller 23*a* is biased with the springs 47, 49 so as to come into contact with the carrying belt 11 elastically.

In the meantime, the power feeding unit of the transfer unit of the present invention is not limited to a roller but conductive brush, conductive rubber blade, conductive sheet or the like may be used. The conductive sheet is a carbon dispersed rubber material or resin film and rubber material such as silicone rubber, urethane rubber, EPDM or resin material such as polycarbonate can be applied. The volume resistance is preferably in a range of $10^5$ to $10^7$ Ωcm.

The structure of the transfer units 23*b*, 23*c* and 23*d* is the same as that of the transfer unit 23*a* and because the structure of elastically making contact with the carrying belt 11 is equal with respect to the respective transfer units, description of the structure of the transfer units 23*b*, 23*c* and 23*d* is not repeated. The magnitude of the biasing force of the springs 47, 49 provided on the respective transfer units 23*a* to 23*d* is set to 600 gft. The biasing force mentioned here refers to a sum of a biasing force 300 gft by the spring 47 and a biasing force 300 gft by the spring 49.

Next, the color image forming operation of the image forming apparatus having the above-described structure will be described.

If image formation start is instructed, the photoconductor drum 3*a* begins to rotate, receiving a drive force from a drive mechanism (not shown). The electrostatic charger 5*a* charges this photoconductor drum 3*a* uniformly to approximately −600 V. The lithography unit 7*a* forms an electrostatic latent image on the surface of this photoconductor drum 3*a* charged uniformly by the electrostatic charger by irradiating light corresponding to an image to be recorded. As a result, an image area as a high potential area and a non-image area as a low potential area are formed on the surface of the photoconductor drum 3*a*. That is, the image area of the photoconductor drum 3*a* turns to approximately 0 V and the non-image area turns to approximately −600 V.

On the other hand, the developing unit 9*a* charges yellow toner negatively and applies development bias of −380 V on the developing sleeve 303 so as to form development field between the developing sleeve 303 and the photoconductor drum 3*a*. As a consequence, negatively charged yellow toner adheres to the image area (approximately 0 V), which is a high potential area of electrostatic latent image of the photoconductor drum 3*a*. That is, yellow toner is inversely developed on the photoconductor drum 3*a*.

After the yellow toner image is formed in this way, the photoconductor drum 3*a* rotates further and reaches a transfer area Ta. At this time, the transfer unit 23*a* applies a transfer bias voltage of approximately +1000 V onto the transfer unit 23*a*, so that transfer field is formed relative to the photoconductor drum 3*a*. The paper P carried by the carrying belt 11 reaches this transfer area Ta and this paper P comes into contact with the photoconductor drum 3*a*, so that negatively charged yellow toner is transferred to the paper P.

On the other hand, the photoconductor drum 3*b* is rotating, receiving a drive force from a drive mechanism (not shown), and then, the electrostatic charger 5*b* charges the surface of the photoconductor drum 3*b* uniformly with approximately −600 V. The lithography unit 7*b* forms an electrostatic latent image on the surface of the photoconductor drum 3*b* charged uniformly by irradiating light corresponding to an image to be recorded. As a consequence, the image area of the photoconductor drum 3*b* turns to approximately 0 V and the non-image area turns to approximately −600 V.

On the other hand, the developing unit 9*b*, as the developing unit 9*a*, applies development bias of −380 V onto the developing sleeve 303 holding magenta toner charged negatively so as to form a development field between the developing sleeve 303 and the photoconductor drum 3*b*. As a consequence, negatively charged magenta toner adheres to the image area (approximately 0 V), which is a high potential area of the electrostatic latent image of the photoconductor drum 3*b*. That is, the magenta toner is inversely transferred to the photoconductor drum 3*a*.

After the magenta toner image is formed, the photoconductor drum 3*a* rotates further and reaches the inverse transfer preventing section 306. The inverse transfer preventing section 306 applies development bias of −380 V onto the sleeve 307 which holds the optically transparent resin particles 309 positively charged so as to form development field between the sleeve 307 and the photoconductor drum 3*b*. As a result, the positively charged optically transparent resin particles 309 adhere to the non-image area (approximately −600 V) which is a low potential area of the electrostatic latent image of the photoconductor drum 3*b*. That is, the photoconductor drum 3*b* holds the magenta toner in the image area (image portion) 501 and the optically transparent resin particles 309 in the non-image area (non-image portion) 502.

The photoconductor drum 3*a* holding the magenta toner and optically transparent resin particles 309 rotates further and reaches the transfer area Tb. At this time, the transfer unit 23*b* is applied with bias voltage of approximately +1200 V from the DC power supply 25*b*, so that transfer field is formed relative to the photoconductor drum 3*b*. The paper P holding Y toner carried by the carrying belt 11 reaches this transfer area Tb and makes contact with the photoconductor drum 3*b*; as a result, negatively charged magenta toner is transfered onto the paper P. That is, the magenta toner is transferred onto the Y toner on the paper P. On the other hand, the positively charged optically transparent resin particles 309 pass the transfer field Tb while being held by the photoconductor drum 3*b* without being transferred onto the paper P.

In this way, the process units 1*c* and 1*d* rotate the photoconductor drums 3*c*, 3*d* so as to charge the surfaces of the photoconductor drums 3*c*, 3*d* uniformly with approximately −600 V by means of the electrostatic chargers 5*c*, 5*d* and form an electrostatic latent image by irradiating the photoconductor drums 3*c*, 3*d* with light corresponding to an image to be recorded by the lithography units 7*c*, 7*d*. C toner and B toner are developed on the image area 501 charged with approximately 0 V so as to develop the optically transparent resin particles 309 on the non-image area 502 charged with −600 V. If the paper P holding the Y toner and magenta toner reaches the transfer area Tc, the transfer unit 23*c* is applied with development bias of +1400 V so as to transfer the C toner to the paper P. If the paper P to which this C toner is transferred reaches the transfer area Td, the transfer unit 23*d* is applied with development bias of +1600 V so as to transfer the B toner to the paper P.

The photoconductor drums 3*b* to 3*d* for transferring toner to the paper P to which the toner has been already transferred can raise the potential of the non-image area 502 by developing the optically transparent resin particles 309 to the non-image area 502. That is, a difference of potential between the potential of the non-image area 502 and the transfer bias to be applied to the transfer units 23*b* to 23*d* can be reduced. Because according to the present embodiment, the optically transparent resin particles 309 of 1 mg/cm$^2$ per unit area adheres to the non-image area 502 of the photoconductor drum 3*b* to 3*d*, the potential of the non-image area 502 can be raised to approximately 150 V to 200 V. Thus, the potential difference of more than +1000 V relative to the transfer bias can be reduced.

Consequently, discharge generated between the paper P reaching the transfer areas Tb-Td and the non-image area 502 can be prevented. With the negative charge maintained, toner already transferred to the paper P can be prevented from being inversely transferred to the photoconductor drums 3*b* to 3*d*. Alternatively, the inverse transfer can be suppressed to such an extent that there is no problem even if it occurs. The optically transparent resin particle 309 is hardly transferred to paper because its charging polarity is inverse to toner. Even if the optically transparent resin particles 309 are transferred to the paper P, there is no visual problem because it is difficult to recognize as it is a resin having optically transparent property. Although white resin is acceptable if the paper P is white, the optically transparent resin particle 309 is preferred to be resin having optically transparent property because the paper P can be a color paper.

Because the inverse transfer of toner from the paper P to the photoconductor drum 3*b* to 3*d* can be prevented, the problem originated from the inverse transfer can be avoided. For example, the problem of color mixture which is caused by the inversely transferred developing agent invading into a photoconductor or a developing unit of a next color, can be avoided, so that change in the hue of a formed image due to color mixture is prevented, thereby achieving stable reproduction of color. Further, an image of excellent quality can be formed by avoiding a problem, caused by an inverse transfer, that the quantity of adhering toner of toner image of each color transferred onto the transfer object medium or the transfer belt decreases.

The present invention is not limited to the above-described embodiments as they are, and may be embodied by modifying the components within a range not departing from the gist of the invention in carrying out the invention. Further, a variety of inventions may be formed by combining plural components disclosed in the embodiments appropriately. For example, it is possible to delete some components from all components indicated in each embodiment. Furthermore, the components covering different embodiments may be combined appropriately.

For instance, although it has been described that the developing units 9*a* to 9*d* accommodate the two-component developing agent constituted of toner and carrier of each color, the present invention is not limited to this, but one-component developing agent may be used. Although it has been described that the developing units 9*b* to 9*d* have the inverse transfer preventing section 306 which accommodates the optically transparent resin particles 309, the present invention is not limited to this, but the developing units 9*b* to 9*d* may be constructed such that the optically transparent resin particles 309 are accommodated in the developing unit casing 300 of the developing units 9*b* to 9*d* and are charged positively (+) so as to adhere to the non-image portion of the photoconductor drums 3*b* and 3*c* together with toner by means of the developing sleeve 303.

According to the present embodiment, toner left on the photoconductor drums 3*a* to 3*d* may be cleaned by a predetermined cleaning member (brush or the like) for cleaning the surface of the photoconductor drums 3*a* to 3*d*. Further, the photoconductor drums 3*a* to 3*d* may be cleaned by collecting left toner by the developing unit casing 300 which accommodates the developing agent, along with a development without using the predetermined cleaning member. If speaking in detail, a method in which when the developing units 9*a* to 9*d* apply development bias of potential between the potential in the non-image area and the potential in the image area to the photoconductor drums 3*a* to 3*d*, the left toner in the non-image area is collected by the developing unit casing 300 while toner accommodated in the developing unit casing 300 is supplied to the image area is called cleaner-less method. A developing unit adopting such a cleaner-less method is more effective because color mixture within the developing unit is prevented as the inverse transfer is prevented.

The developing agent of each color described above contains toner whose average diameter (50% diameter in volume distribution) is 7 micron and ferrite magnetic carrier particle whose average particle diameter is approximately 60 micron and when the toner and carrier are agitated, the toner is charged negatively and the carrier is charged positively due to frictional electrification.

Although according to the present embodiment, the color image forming apparatus for forming an image with plural toners has been described as a unit adopting the consecutive four-drum method, the present invention is not restricted to this example, but it is possible to adopt intermediate transfer method in which a color image is formed on the intermediate transfer body by overlaying four color toner images one over the other and transferred to a transfer object medium at once.

As described above, the optically transparent resin particle 309 for use in the present invention is a particle capable of being charged to an opposite polarity to the charging property of toner and contains at least optically transparent resin. Further, this optically transparent resin particle 309 may contain, for example, charging control agent and addition agent such as filler. This optically transparent resin particle 309 is non-color, transparent or may have a color which does not damage the hue of the developing agent even if it is fixed together with the developing agent of each color.

Further, as the optically transparent resin particle 309, it is possible to use, for example, polystyrene/acrylic copolymer resin, polyvinyl chloride, polycarbonate resin, polyethylene terephthalate or the like.

(i) A method of manufacturing the developing agent and optically transparent resin particle, which can be adapted when charging the toner negatively and the optically transparent resin particle positively as the present embodiment, will be described.

(Y) Yellow Toner Particle Material

Coloring agent: C.I pigment yellow 180, 8 parts by weight

Binder resin: polyester resin, acid value 10 KOHmg, softening point 120° C., weight-average molecular weight 45000, number-average molecular weight 3000, 100 parts by weight Charging control agent: Zr metal complex, 1-parts by weight Wax 1: rice wax, melting point 79° C., 2 parts by weight Wax 2: PP wax, melting point 145° C., 5 parts by weight The toner particle material having the above-described composition was mixed, melted and agitated. An obtained mixed matter was crushed roughly and crushed finely and then classified so as to obtain a toner particle having a volume average particle diameter (50% diameter in volume distribution) of 7 μm.

Hydrophobic silica of 2.5 parts by weight and hydrophobic titanium oxide of 0.5 parts by weight were added and mixed to the obtained toner particles of 100 parts by weight using a Henschel mixer so as to obtain negatively charged toner.

Ferrite carrier of 92 parts by weight was mixed with the obtained negatively charged toner of 8 parts by weight so as to obtain negatively charged yellow developing agent.

(M) Magenta Toner Particle Material

Coloring agent: C.I. pigment red 57-1, 8 parts by weight

Binder resin: polyester resin, acid value 10 KOHmg, softening point 120° C., weight-average molecular weight 45000, number-average molecular weight 3000, 100 parts by weight Charging control agent: Zr metal complex, 1 parts by weight Wax 1: rice wax, melting point 79° C., 2 parts by weight Wax 2: PP wax, melting point 145° C., 5 parts by weight Negatively charged magenta developing agent can be obtained in the same manner as the above-mentioned yellow developing agent is obtained except that the magenta toner particle material having the above-mentioned is used.

(C) Cyan Toner Particle Material

Coloring agent: C.I. pigment blue 15-3, 8 parts by weight

Binder resin: polyester resin, acid value 10 KOHmg, softening point 120° C., weight-average molecular weight 45000, number-average molecular weight 3000, 100 parts by weight Charging control agent: Zr metal complex, 1 parts by weight Wax 1: rice wax, melting point 79° C., 2 parts by weight Wax 2: PP wax, melting point 145° C., 5 parts by weight Negatively charged cyan developing agent can be obtained in the same manner as the yellow developing agent is obtained except that the cyan toner particle material having the aforementioned composition is used.

(309) Optically Transparent Resin Particle

Binder resin: polyester resin, acid value 3 KHOmg, softening point 120° C., 100 parts by weight Charging control agent: class 4 ammonium salt, 1 parts by weight The optically transparent resin particle material having the above-described composition was mixed, melted and agitated. An obtained mixed matter was crushed roughly and crushed finely and then classified so as to obtain a positively charged optically transparent resin particle having a volume average particle diameter (50% diameter in volume distribution) of 10 μm. If fluidity is insufficient, hydrophobic silica can be added, as it is added to the toner.

(ii) A manufacturing method of the positively charged developing agent and negatively charged optically transparent resin particle used for the present invention and to which normal transfer phenomenon can be applied different from the present embodiment will be described.

Positively charged yellow developing agent, positively charged magenta developing agent, positively charged cyan developing agent, and negatively charged optically transparent resin particle were obtained in the same manner as described in the (i) except that following materials were used.

(Y) Yellow Toner Particle Material

Coloring agent: C.I. pigment yellow 180, 8 parts by weight

Binder resin: polyester resins, acid value 3 KOHmg, softening point 120° C., weight-average molecular weight 45000, number-average molecular weight 3000, 1 part by weight Charging control agent: class 4 ammonium salt, 1 parts by weight Wax 1: rice wax, melting point 79° C., 2 parts by weight Wax 2: PP wax, melting point 145° C., 5 parts by weight (M) Magenta Toner Particle Material Coloring agent: C.I. pigment red 57-1, 8 parts by weight Binder resin: polyester resin, acid value 3 KOHmg, softening point 120° C., weight-average molecular weight 45000, number-average molecular weight 3000, 100 parts by weight Charging control agent, class 4 ammonium salt, 1 parts by weight Wax 1: rice wax, melting point 79° C., 2 parts by weight Wax 2: PP wax, melting point 145° C., 5 parts by weight (C) Cyan Toner Particle Material Coloring agent: C.I. pigment red 15-3, 8 parts by weight Binder resin: polyester resin, acid value 10 KOHmg, softening point 120° C., weight-average molecular weight 45000, number-average molecular weight 3000, 100 parts by weight Charging control agent, class 4 ammonium salt, 1 parts by weight Wax 1: rice wax, melting point 79° C., 2 parts by weight Wax 2: PP wax, melting point 145° C., 5 parts by weight (309) Optically Transparent Resin Particle Material Binder resin, polyester resin, acid value 10 KHOmg, softening point 120° C., 100 parts by weight Charging Control Agent: Zr Metal Complex, 1 Parts by Weight The optically transparent resin particle material having the above-described composition is mixed, melted and agitated. An obtained mixed matter is crushed roughly and crushed finely and then classified so as to obtain a positively charged optically transparent resin particle having a volume average particle diameter (50% diameter in volume distribution) of 10 μm. If fluidity is insufficient, hydrophobic silica is added as it is added to the toner.

What is claimed is:

1. A developing unit comprising:

a developing section including a first accommodating section which accommodates a developing agent, and a developing agent supply mechanism which supplies the developing agent to an image carrier with a predetermined potential difference formed relative to the image carrier; and an inverse transfer preventing section including a second accommodating section which accommodates an inverse transfer preventing agent, and a mechanism to supply inverse transfer preventing agent which supplies the inverse transfer preventing agent supplied with inverse polarity of the developing agent to the image carrier with a predetermined potential difference formed relative to the image carrier.

2. The developing unit according to claim 1, wherein the inverse transfer preventing agent is a particle constituted a resin having at least an optically transparent property.

3. The developing unit according to claim 1, wherein the mechanism to supply inverse transfer preventing agent is disposed at a different position from a supply position of the developing agent from the first accommodating section with respect to the image carrier.

4. The developing unit according to claim 1, wherein the mechanism to supply inverse transfer preventing agent includes an inverse transfer preventing agent carrier which is provided in non-contact with the image carrier, has a predetermined potential difference with respect to the image carrier and supplies the inverse transfer preventing agent to the first image carrier.

5. The developing unit according to claim 4, further comprising;

a voltage applying mechanism which applies a bias voltage in which AC voltage is overlaid on DC voltage to the inverse transfer preventing agent carrier.

6. The developing unit according to claim 1, wherein the second accommodating section which accommodates the inverse transfer preventing agent is arranged on a downward side in a rotation direction of the image carrier with respect to the supply position of the developing agent, and the inverse transfer preventing agent is supplied to the image carrier.

7. The developing unit according to claim 1, wherein the developing agent and the inverse transfer preventing agent are accommodated in a same accommodating container.

8. The developing unit according to claim 1, wherein the developing unit supplies the developing agent to the image carrier and collects the developing agent left in the image carrier.

9. An image forming apparatus comprising:

a first image carrier on which an electrostatic latent image constituted of an image portion having a predetermined potential and a non-image portion having a different potential from the potential of the image portion is formed;

a first developing agent supply mechanism which supplies the developing agent of a first color to the image portion by supplying electric charge of polarity corresponding to the image portion to the developing agent of the first color; and an inverse transfer preventing section which supplies the inverse transfer preventing agent to the non-image portion by supplying the inverse transfer preventing agent with electric charge having an inverse polarity to the developing agent of the first color.

10. The image forming apparatus according to claim 9, further comprising;

a carrying unit which carries a transfer object medium to which the developing agent of the first color is to be transferred, opposing the first image carrier;

a second image carrier which is disposed on the upstream side in a carrying direction of the carrying unit with respect to the first image carrier, opposing the carrying unit and on which an electrostatic latent image constituted of the image portion having a predetermined potential and the non-image portion having a different potential from the potential of the image portion is formed; and a second developing agent supplying mechanism which supplies the image portion with the developing agent of the second color by supplying electric charge of a polarity corresponding to the image portion of the second image carrier to the developing agent of a second color different from the first color.

11. The image forming apparatus according to claim 10, further comprising;

a first process unit which is provided detachably on the image forming apparatus main body, the first process unit holding the first image carrier, the first developing agent supply mechanism and the inverse transfer preventing section integrally.

12. The image forming apparatus according to claim 11, further comprising;

a second process unit which is located on the upstream side of the first process unit in the carrying direction of the carrying unit, the second process unit holding the second image carrier and the second developing agent supply mechanism integrally, and being provided detachably on the image forming apparatus main body.

13. The image forming apparatus according to claim 9, wherein the inverse transfer preventing agent is a particle constituted of a resin having at least an optically transparent property.

14. The image forming apparatus according to claim 9, wherein the inverse transfer preventing section includes an inverse transfer preventing agent carrier which is provided in non-contact with the first image carrier, the inverse transfer preventing agent carrier having a predetermined potential difference with respect to the first image carrier, and supplying the inverse transfer preventing agent to the first image carrier.

15. The image forming apparatus according to claim 14, further comprising;

a voltage applying mechanism which applies a bias voltage in which AC voltage is overlaid on DC voltage to the inverse transfer preventing agent carrier.

16. The image forming apparatus according to claim 9, wherein the inverse transfer preventing agent is supplied to the first image carrier on the downward side in a rotation direction of the first image carrier with respect to a supply position of the developing agent.

17. The image forming apparatus according to claim 9, wherein the first developing agent supply mechanism supplies a developing agent of the first color to the image portion of the first image carrier, and collects the developing agent of the first color left in the first image carrier.

18. An image forming method comprising: charging a surface of an image carrier with a first potential;

forming an image portion having a second potential different from the potential of the first potential on the surface by irradiating light corresponding to predetermined image information;

applying developing agent of the first color charged with a predetermined polarity on the image portion;

applying the inverse transfer preventing agent charged with an inverse polarity to the developing agent on a non-image portion having the first potential, on a downward side in a rotation direction of the image carrier with respect to the applying developing agent on the image carrier; and transferring an image of a developing agent of the first color to a transfer object medium to which an image of a second developing agent different from the first color is already transferred.

19. A developing unit comprising:

developing means for including first accommodating means for accommodating developing agent, and developing agent supply means for supplying the developing agent to image carrying means with a predetermined potential difference formed relative to the image carrying means; and inverse transfer preventing means for including second accommodating means for accommodating an inverse transfer preventing agent and a means for supplying inverse transfer preventing agent which supplies the inverse transfer preventing agent supplied with inverse polarity of the developing agent to the image carrying means with a predetermined potential difference formed relative to the image carrying means.

20. An image forming apparatus comprising:

first image carrying means on which an electrostatic latent image constituted of an image portion having a predetermined potential and a non-image portion having a different potential from the potential of the image portion is formed;

first developing agent supply means for supplying the developing agent of a first color to the image portion by supplying electric charge of polarity corresponding to the image portion to the developing agent of the first color; and inverse transfer preventing means for supplying inverse transfer preventing agent to the non-image portion by supplying the inverse transfer preventing agent with electric charge having an inverse polarity to the developing agent of the first color.

21. The image forming apparatus according to claim 19, wherein the second accommodating section of the inverse transfer preventing agent is arranged on a downward side in a rotation direction of the image carrier with respect to a supply position of the developing agent.

22. The image forming apparatus according to claim 20, further comprising:

inverse transfer preventing agent accommodating means, arranged on a downward side in a rotation direction of the image carrier with respect to a supply position of the developing agent, for applying the inverse transfer preventing agent charged with an inverse polarity to the developing agent on the non-image portion having a first potential.

* * * * *